United States Patent [19]

Bullock

[11] 4,216,690

[45] Aug. 12, 1980

[54] APPARATUS FOR PERFORATING SLICES OF FOOD PRODUCT

[76] Inventor: Robert F. Bullock, 1708 Iris Dr., Conyers, Ga. 30207

[21] Appl. No.: 6,889

[22] Filed: Jan. 26, 1979

[51] Int. Cl.[2] ..... B26D 7/06; B26F 1/24

[52] U.S. Cl. ..... 83/114; 83/155; 83/345; 83/422; 83/660

[58] Field of Search ..... 83/114, 113, 120, 155, 83/345, 660, 867, 422; 17/26; 426/281

[56] References Cited

U.S. PATENT DOCUMENTS

| | | | |
|---|---|---|---|
| 89,985 | 5/1869 | Gray | 83/114 |
| 128,189 | 6/1872 | Towar | 83/113 |
| 2,619,051 | 11/1952 | Rice | 83/114 X |
| 2,935,105 | 5/1960 | Musgrave | 83/867 |
| 3,084,730 | 4/1963 | Stahmer | 17/26 X |
| 3,538,797 | 11/1970 | Wagtskjold | 83/114 X |
| 3,703,917 | 11/1972 | Mundy | 83/867 |

*Primary Examiner*—Frank T. Yost
*Attorney, Agent, or Firm*—Newton, Hopkins & Ormsby

[57] ABSTRACT

A foraminous upperwardly inclined conveyor belt, which normally carries slices of vegetable, such as potatoes from the washer to the cooker is straddled by a spiked roller on the bottom side and a grooved roller on the other for progressively puncturing the vegetable while carried on the conveyor.

8 Claims, 6 Drawing Figures

APPARATUS FOR PERFORATING SLICES OF FOOD PRODUCT

BACKGROUND OF THE INVENTION

1. Field of the Invention

This invention relates to the perforating of food products and is more particularly concerned with an apparatus for and method of perforating slices of food product such as potatoes, prior to frying the same.

2. Description of the Prior Art

In the past, slices of potatoes have been progressively fed to and washed in a washer and then received on a conveyor which carries the same up an incline and discharges them progressively into the entrance end of a hooded cooker where the potato slices are cooked in oil and discharged. The inclined conveyor may pass beneath an air knife which partially drys the slices carried thereby.

In the cooker a substantial number of the slices develop blisters which are unsightly and at times captures oil. Such blistered potato chips which contain oil are usually rejected when the chips are physically inspected by an inspector. Also, at times, the chips crumble and must be rejected. Thus, it is not unusual to have 500 pounds of waste in 16,000 pounds of potato chips.

Using Ohio Norchip potatoes (1978) for unperforated flat slices, it was found that the average potato chip, in frying absorbed or retained sufficient oil to constitute about 43% by weight, oil. When, however, the raw slices were perforated, as hereinafter set forth, and otherwise handled identically, average potato chip produced was only 38.8%, by weight, oil.

Using Red River Valley (North Dakota-Minnesota) Norchip potatoes and the process herein disclosed, the oil content of an average flat potato chip was reduced from 41.6% to 39.8%. Ruffled or wavy potato chip showed a drop in oil content from 39.2% to 38.0%.

An inspection of the potato chips which were produced from perforated slices, as herein disclosed, showed that fewer blisters and smaller blisters developed thereon when compared with the prior art procedure of frying unperforated slices. Also, the holes or perforations appear to have closed during frying.

In the past, devices for perforating vegetables have been devised. U.S. Pat. Nos. 3,139,129; 3,381,731; 2,715,927 and 2,567,248 disclose such prior art devices. The prior art devices are usually quite complex requiring that the food product be moved in a circular path or requiring expensive power driven mechanisms installed between washing stations. Such prior perforating equipment cannot be readily installed on existing equipment.

SUMMARY OF THE INVENTION

Briefly described, the present invention includes a flat wire, open mesh belt conveyor which progressively feeds slices of food product, such as potato slices from a conventional washer, beneath a conventional air knife to a conventional hooded cooker in which heated oil or fat frys the slices. Extending transversely of and straddling the upper flight of the conveyor are a pair of opposed rollers, the lower roller being a spiked roller and the upper roller being mandrel having circumferential grooves through which the spikes may protrude. The upper periphery of the spiked roller is immediately below the upper flight so that the spikes protrude through the belt and puncture the slices of potatoes, the belt pulling the spikes to rotate the lower roller synchronously with the travel of the belt. A drive belt drives the upper roller from the lower roller.

The upper roller is adjustable for various thicknesses of potato slices and if desired may be readily and easily removed to permit the slices to ride over the spikes without being perforated.

Accordingly, it is an object of the present invention to provide an apparatus for perforating food products which is inexpensive to manufacture, durable in structure and efficient in operation.

Another object of the present invention is to provide an apparatus for and process of progressively perforating slices of potatoes while conveying the same to the cooker.

Another object of the present invention is to provide a method and apparatus for reducing the blistering of potato chips.

Another object of the present invention is to provide, in a method of producing fried potato chips, a process and means for reducing the oil in the resulting fryed product, while preserving the integrity of the chips, improving its appearance.

Another object of the present invention is to improve the yield of existing equipment for frying potato slices and thereby reduce the cost of the potato chip.

Other objects features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figure 1:
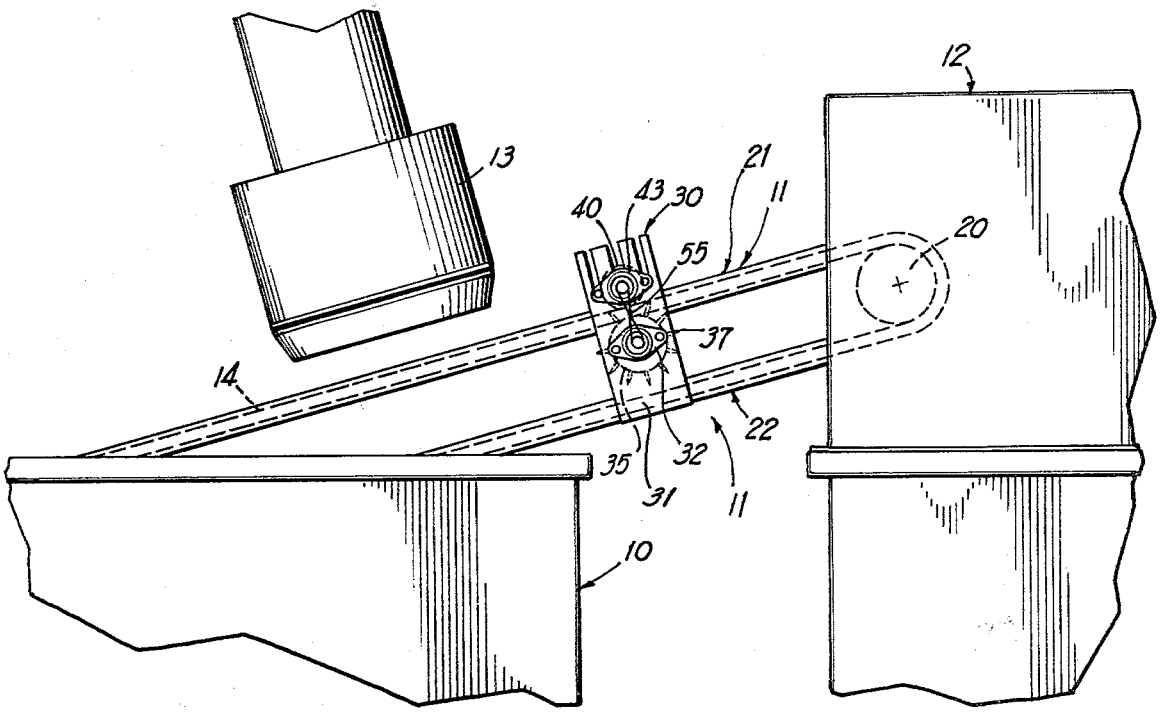
FIG. 1 is a fragmentary side elevational view of a portion of the conventional apparatus for washing and frying potato slices, having incorporated therein an apparatus for perforating the potato slices, constructed in accordance with the present invention.

Referring now in detail to the embodiment chosen for the purpose of illustrating the present invention, numeral 10 in FIG. 1 denotes generally a conventional washer into which slices of potatoes are progressively deposited and, after being washed, are carried, by a conveyor 11, along an upwardly and forwardly inclined path and progressively deposited in the entrance end of a hooded cooker 12 for frying.

As the potato slices S are carried along their inclined path by the upper flight of the conveyor 11, they pass beneath an air knife 13 which is disposed above the washer and also above the upper flight of conveyor 11, as shown in FIG. 1.

Figure 2:
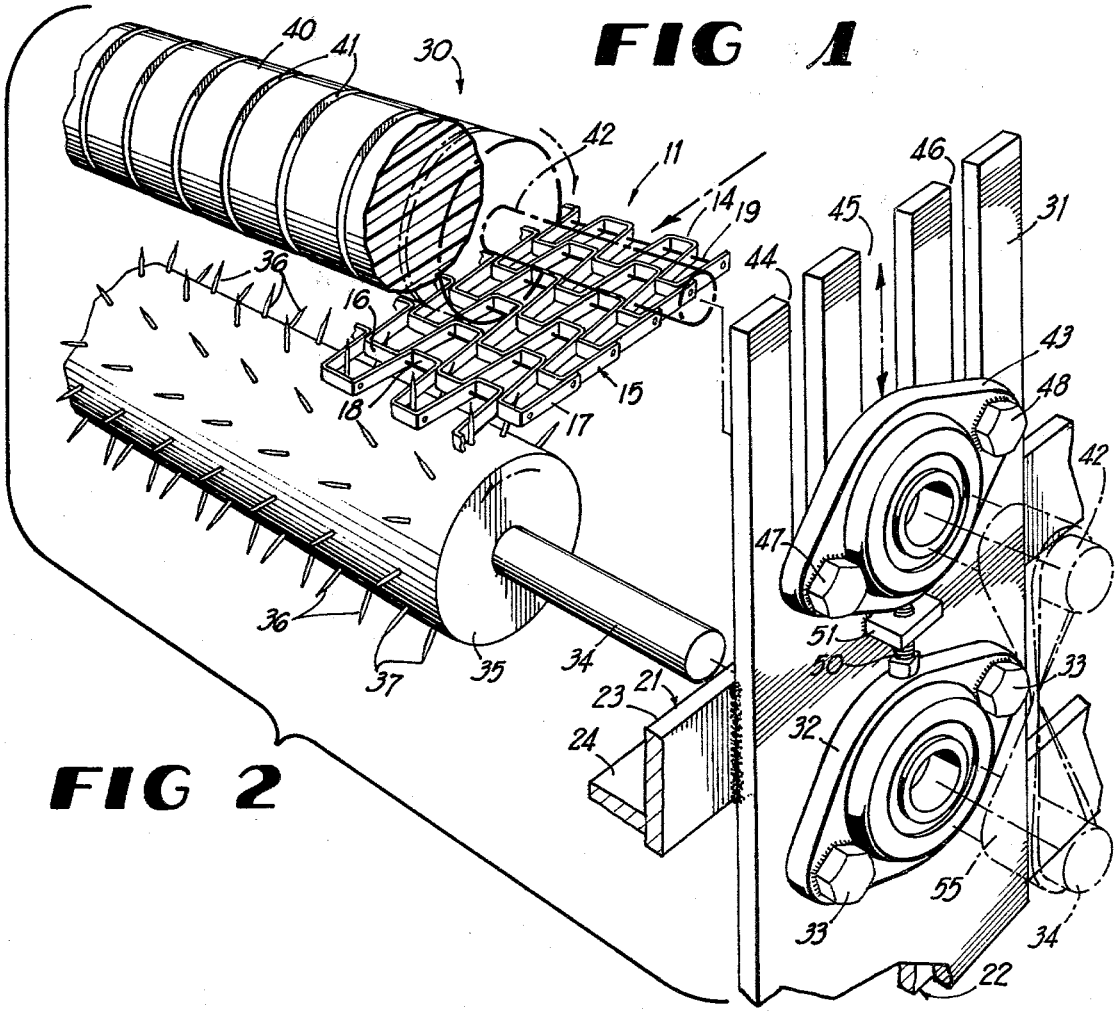
FIG. 2 is an enlarged exploded perspective view of a portion of the apparatus depicted in FIG. 1.

The conveyor 11 includes a continuous, open mesh, flat wire belt 14, seen best in FIG. 2. The links of the belt 14 are respectively formed of flat steel tape or wire 15 bent so as to produce alternately opening, U-shaped, integrally connected increments. The increments include spaced transversely aligned, rear bases 16, the ends of which are integrally connected to the proximal ends of opposed pairs of diverging legs 17 which extend genrally longitudinally to connect to an adjacent pair of spaced, transversely aligned, front bases 18. The front bases 18 of one transverse wire 15 is straddled by the diverging distal end portions of the legs 17 of the next wire 15. Hence, bases 16 and 18 are staggered transversely, but bases 16 are aligned in equally spaced rows longitudinally and bases 18 are also aligned in equally spaced longitudinal rows. Spaced, parallel, transversely extending pivot rods 19 project through the overlapped legs 17 to form the foraminous belt 14 which is transversely substantially rigid but have the wire increments 15 which readily pivot about the transverse axes of rods 19.

The ends of belt 14 pass around opposed rollers, such as roller 20 in FIG. 1, one roller (not shown) being in the washer 10 and the other in the cooker 12.

Transversely opposed pairs of rugid, guide rails 21 and 22 support, for sliding action, the edges of the upper and lower flights of belt 14. The ends of the guide rails 21 and 22 are respectively secured to upper portion of washer 10 and extends into the entrance end of the cooker 12. Each guide rail 21 and 22 includes a vertical plate 23 carrying an inwardly extending belt supporting flange 24. The structure thus far described is conventional.

According to the present invention, a perforating assembly 30 is installed on the guide rails 21 and 22 of the conveyor frame by installing opposed, complimentary, roller supporting brackets 31 thereon.

Each bracket 31 is a flat, rigid, rectangular, metal plate which is perpendicular to the guide rails 21 and 22 and is longer than the distance between the two guide rails 21 and 22 so as to have a lower portion secured, as by welding or bolting to the lower guide rail 22 and an intermediate portion secured, as by welding or bolting to the upper guide rail 21.

Between the guide rails 21 and 22, the brackets 31 are each provided with a lower fixed, self aligning, bearing 32 secured to bracket 31 by bolts 33. The bearings, such as bearing 32 respectively journal, for rotation, the oppositely extending, axially aligned, trunion shafts 34 which protrude through openings (not shown) in the brackets, such as bracket 31, and outwardly of the bearings, such as bearing 32.

Figure 3:
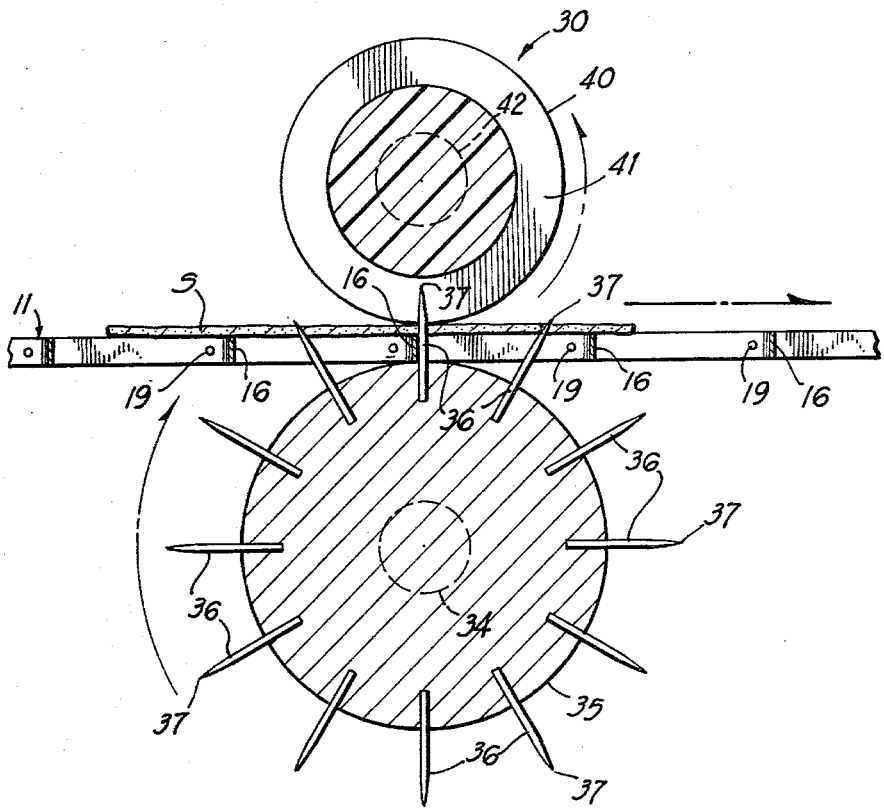
FIG. 3 is an enlarged vertical sectional view of the mechanism depicted in FIG. 2 operating to perforate a potato slice.
Figure 4:
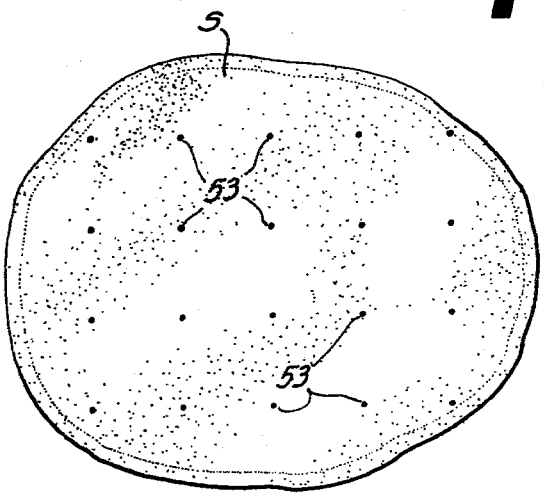
FIG. 4 is an enlarged plan view of a typical potato chip formed from the slice of FIG. 3, after it has been perforated and then fried.

Shafts 34 concentrically carries a spiked, fixed or keyed thereto, cylindrical roller or drum 35, seen best in FIG. 2. The length of roller 35 corresponds generally to the width of belt 14. The diameter of roller 35 is substantially less than the distance between the upper flight of belt 14 and the lower flight of belt 14. The bearings 32 are so disposed that the upper periphery of roller 35 is tangential to the lower surface of the upper flight of belt 14, as depicted in FIG. 3.

The drum or roller 35 is provided with a plurality of radially extending spikes, tines or prongs 36 which are equally spaced in axial rows, the axial rows being circumferentially equally spaced from each other. The spikes 36 are circumferentially or radially aligned in axially spaced rows, the spacing of adjacent spikes 36 in the axial rows of spikes 36 being equal to the transverse spacing of bases 16 so that, preferably, a spike 36 of an axial row is provided for each base 18.

Furthermore, the circumferential spacing at the tips 37 of the circumferentially adjacent spikes 36 is approximately less than the distance between the longitudinally aligned bases 18, whereby the bases 18 in a transverse row will engage the spikes 36 in an axial row, inwardly of their tips or points 37 and pull the spikes 36 around in sprocket like fashion, allowing some slipage to assure that no tip or point 37 is dulled by engagement with a base.

The spikes 36 are firmly embedded by their shanks in the drum or roller 35 and protrude outwardly from the periphery of the roller 35 by a distance greater than the thickness of the belt 14 so as to protrude above or outwardly through the belt 14 during a period immediately before to a period immediately after the drum periphery is tangential to the upper flight of the belt 14, while clearing, altogether, the lower flight of belt 14.

Cooperating with the drum or lower roller 35 is an upper or outer mandrel drum or roller 40 which is on the opposite or outer side of belt 14. This mandrel roller 40 is cylindrical and of a length about equal to the length of roller 35. It has equally spaced circumferential grooves 41 which are slightly wider than the diameter of spikes 36 and deeper than the distance the spike 36 protrudes from the outer surface of the belt 14. The axial distance between adjacent grooves equals the distance between adjacent spikes 36 in each axial row.

Mandrel roller 40 is of smaller diameter than the roller 35 and has oppositely extending trunion shafts 42 at its ends. The trunion shafts 42 are journalled by vertically adjustable bearings such as bearing 43.

As best seen in FIG. 2, the brackets, such as bracket 31, have three parallel, upwardly opening slots 44, 45 and 46. The central slot 45 is in alignment with the axes of bearings 32 and is wider than the diameter of the trunion shafts 42. The shaft 42 protrudes through these central slots in being journalled by the bearings 43. These bolts 47 and 48 are fixed to journal 43. The shanks (not shown) of bolts 47 and 48 are of a slightly smaller diameter than the slots 44 and 46 which allows them to slide vertically within the confines of slots 44 and 46 thereby providing a vertical guide means for bearing 43 to which bolts 47 and 48 are fixed.

A set screw 50, below each bearing 43, is threadedly carried by an outwardly protruding flange 51, on the bracket 31. By manipulation of the set screw 50, the desired down position of bearing 43 can be varied incrementally, thereby varying the distance between the lower periphery of mandrel roller 40, to adjust for different thicknesses of potato slices S, but more over the set screw so can be adjusted to raise mandrel roller 40 out of engagement with the slices of S of potatoes.

When it is desired that no perforations or holes be produced, the mandrel roller 40 may simply be removed. Then the slices S pass over the spikes tips 37 and are lifted but not pierced.

A pair of rubber band type resilient belts, such as belt 55 pass between the shafts 34 and 42, at both ends, each belt being twisted so as to drive the shafts 42 from shafts 34 but in an opposite direction. This resilient linkage of the rollers allows the mandrel roller 40 to operate in a variable suspend mode which allow slices stacked upon each other or of different thinknesses to be punched without damage to the slices S.

The needle like spikes 36 are approximately ⅛ inch in diameter and can vary from about 1/10 inch to 3/16 inch to produce holes suitable for producing the longitudinal and transverse rows of holes 53 in the slices.

Figure 5:
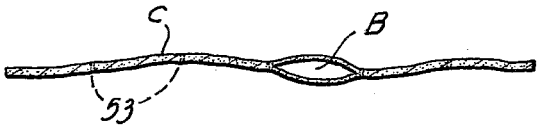
FIG. 5 is a cross sectional view of the typical perforated chip of FIG. 4.
Figure 6:
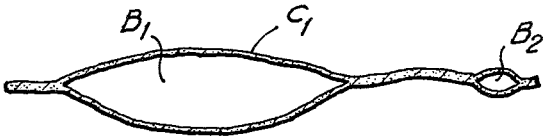
FIG. 6 is a cross sectional view similar to FIG. 5, but depicting a typical conventional non-perforated potato chip formed using the conventional equipment depicted in FIG. 1, without the apparatus for perforating the same.

The resulting fryed potato chip of FIG. 5, formed from the slices S with the perforations 53, has fewer and smaller blisters B therein and averages requiring less oil for frying than the prior art unperforated potato chip C, with its larger blisters B, and greater number of blisters, such as B1 and B2.

The mandrel roller 40 acts as a "squeegee" to wring some of the water from the slice S so that it may be dryer than it otherwise would be.

The pronges or spikes 36 which rub against the belt 14 are progressively cleaned thereby so that excessive starch does not accumulate therein.

Because there are fewer and smaller blisters B, fewer chips are rejected, thereby lightening the work of the inspector and increasing the yield of useable chips. It is estimated that as a result of reduction in oil consumption, oil saved, per day of normal operation, in producing 16,000 pounds of potato chips from the Ohio Norchip potatoes mentioned above, resulted in a savings in oil alone of about $287.00 per day. Also, the stack gases from the cooker are, thus, cleaner.

In operations where the washer 10 is not employed, the perforating assembly 30 is installed outwardly adjacent to the cooker 12 for operation with the conveyor 11 which leads to the cooker 12.

It will be obvious to those skilled in the art that many variations may be made in the embodiments chosen for the purpose of illustrating the present invention without departing from the scope of the invention, as defined by the appended claims.

I claim:

1. In an apparatus for conveying slices of food product in which the slices are carried by the upper surface of the upper flight of a moving continuous belt, the combination therewith of:

(a) a roller adjacent to and beneath said upper flight, said roller having an axis of rotation transverse to the direction of travel of said upper flight of said belt;

(b) a plurality of spikes protruding outwardly from the periphery of said roller, said roller being sufficiently close to the lower surface of said upper flight that the spikes carried by said roller project through said upper flight and outwardly of the upper surface of said upper flight; and (c) means for retarding outward movement of said slices from said upper surface so that said slices are progressively perforated by said spikes as they are moved along their path of travel by said upper flight.

2. The apparatus defined in claim 1 wherein said spikes are disposed circumferentially around the periphery of said rollers so that at least some of said spikes protrude through said belt at all times.

3. The apparatus defined in claim 2 wherein said spikes are disposed in axial and circumferential rows.

4. The apparatus defined in claim 1 wherein said spikes are engaged by said belt for rotating said roller.

5. The apparatus defined in claim 1 wherein said means for retarding outward movement of said slices includes a roller, the lower periphery of which is disposed adjacent to said upper surface, said roller having an axis transverse to the path of travel of said upper flight.

6. The apparatus defined in claim 5 wherein said roller is provided with openings through which said spikes project.

7. The apparatus defined in claim 5 including means for yieldably supporting the last mentioned roller so that it may move away from said upper surface of said upper flight when said slices pass therebeneath.

8. The apparatus defined in claim 7 including drive means for interconnecting the rollers so that the last mentioned roller is driven by the first mentioned roller, said spikes engaging said belt for the driving of said first mentioned roller thereby.

* * * * *